United States Patent [19]

Fujikawa

[11] 4,124,008

[45] Nov. 7, 1978

[54] INTEGRATED FUEL SUPPLY SYSTEM FOR AN INTERNAL COMBUSTION ENGINE INCLUDING FILTER, VALVE, AND PUMP

[75] Inventor: Tetsuzo Fujikawa, Akashi, Japan

[73] Assignee: Kawasaki Jukogyo Kabushiki Kaisha, Kobe, Japan

[21] Appl. No.: 746,771

[22] Filed: Dec. 2, 1976

[30] Foreign Application Priority Data

Dec. 5, 1975 [JP] Japan ..... 50-165348[U]

[51] Int. Cl.[2] ..... F02M 39/00; F04B 35/02

[52] U.S. Cl. ..... 123/139 AH; 123/139 A; 123/139 AJ; 417/380

[58] Field of Search ..... 123/139 AH, 139 A, 139 AJ, 123/73; 417/46, 380, 395; 239/87

[56] References Cited

U.S. PATENT DOCUMENTS

| | | | |
|---|---|---|---|
| 1,834,977 | 12/1931 | Schweisthal | 123/139 AH |
| 2,713,854 | 7/1955 | Conover | 123/139 AH |
| 2,714,853 | 8/1955 | Schlamann | 123/139 AH |
| 3,805,758 | 4/1974 | May | 417/380 |
| 4,055,609 | 10/1977 | Phelps | 417/380 |

FOREIGN PATENT DOCUMENTS

| | | | |
|---|---|---|---|
| 1,113,117 | 8/1961 | Fed. Rep. of Germany | 123/139 AH |
| 930,988 | 2/1948 | France | 123/139 AH |

*Primary Examiner*—Charles J. Myhre
*Assistant Examiner*—P. S. Lall
*Attorney, Agent, or Firm*—Sughrue, Rothwell, Mion, Zinn and Macpeak

[57] ABSTRACT

An integrated fuel supply unit 10 includes a filter 18, a spring biased supply valve 21 operated by a valve diaphragm 22, and a pump chamber 38. Fuel enters and leaves the pump chamber through non-return flap valves 37, 39 incorporated in the diaphragm 22, and the latter is deflected to open the supply valve by a chamber 29, 29′ pressurized through a non-return bleed valve 30, 30′ by the pulsating engine crankcase pressure, which also operates (reciprocates) the fuel pump diaphragm.

7 Claims, 5 Drawing Figures

INTEGRATED FUEL SUPPLY SYSTEM FOR AN INTERNAL COMBUSTION ENGINE INCLUDING FILTER, VALVE, AND PUMP

BACKGROUND OF THE INVENTION

This invention relates to a fuel supply device for an internal combustion engine of the type which utilizes pulsating pressure from the engine crankcase, and more particulary to an integrated fuel supply structure or assembly including, in a single unit, a fuel filter, an automatic fuel supply valve, and a fuel pump.

Generally, a vehicle system for supplying fuel from a tank to a carburetor includes, as separate components, a fuel filter, an automatic fuel supply valve, and a fuel pump. That is, these components are independent from each other as shown in FIG. 1, and it is therefore necessary to provide a number of interconnecting lines, such as a fuel inlet line 2 for connecting a fuel filter 1 to a fuel tank (not shown), lines 5, 6 for connecting an automatic fuel valve 3 between the filter 1 and a fuel pump 4, a fuel outlet line 7 for connecting the pump 4 to a carburetor (not shown), and lines 8, 9 for transmitting pulsating pressure from an engine crankcase (not shown) to the valve 3 and pump 4, respectively. Thus, it takes considerable time to assemble the components and to connect the lines therebetween. Further, the provision of such a large number of lines increases the likelihood of accidents and fire due to fuel leaks developing in the lines and their connections.

SUMMARY OF THE INVENTION

Accordingly, an object of this invention is to eliminate the above-described defects in the conventional fuel supply system.

Another object of the invention is to provide a compact and easily assembled fuel supply device which integrally includes a fuel filter, an automatic fuel supply valve, and a fuel pump in a single unit.

Briefly, and in accordance with the present invention, an integrated fuel supply unit includes a filter, a spring biased supply valve operated by a valve diaphragm, and a pump chamber. Fuel enters and leaves the pump chamber through non-return flap valves incorporated in the diaphragm, and the latter is deflected to open the supply valve by a chamber pressurized through a non-return bleed valve by the pulsating engine crankcase pressure, which also operates (reciprocates) the fuel pump diaphragm.

DETAILED DESCRIPTION OF THE PREFERRED EMBODIMENTS

Figure 2:
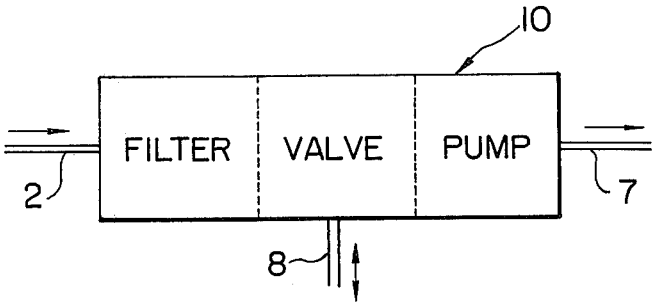
FIG. 2 shows a block diagram of an integrated fuel supply system according to the present invention.
Figure 3:
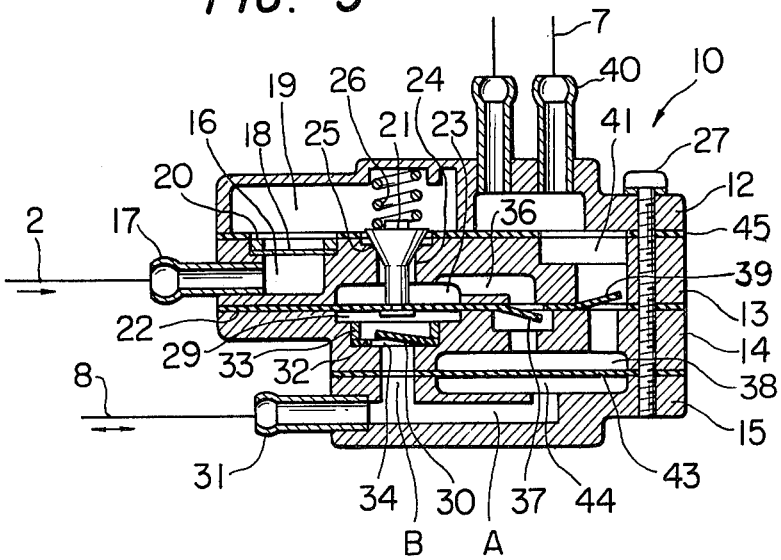
FIG. 3 shows a longitudinal sectional view of an embodiment of the present invention of the type wherein an automatic fuel supply valve is operated by positive pulsating pressure.
Figure 4:
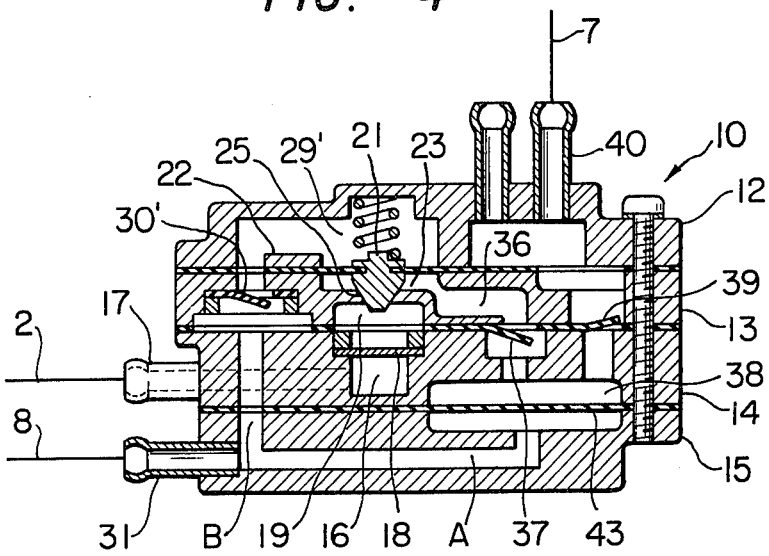
FIG. 4 shows a longitudinal sectional view of a similar embodiment wherein the automatic fuel supply valve is operated by negative pulsating pressure.

FIG. 2 schematically shows an integrated fuel supply system 10 according to the present invention including a fuel filter section, an automatic fuel valve section, and a fuel pump section integrally combined together, as shown in detail in FIGS. 3 and 4.

Turning now to the embodiment of FIG. 3, reference numeral 12 designates an upper cover. A fuel intake line 17 is sealingly mounted in an L-shaped passage 16 in an upper body 13. The L-shaped passage is connected to a chamber 19 through a round fuel filter screen 18. The filter 18 is mounted on the stepped outlet portion of the passage 16 by a ring 20. The chamber 19 is connected to a chamber 23 above a valve operating diaphragm 22 through a valve 21. The valve 21 engages a valve seat 25 on the upper portion of a passage 24 in the upper body 13 under the force of a compression spring 26, to thereby normally close the passage 24. The diaphragm 22 is mounted between upper and lower bodies 13, 14 by assembly bolts 27, only one being shown. The lower stem portion of the valve 21 is secured to the central portion of the diaphragm 22.

A positive pressure chamber 29 below the diaphragm 22 communicates with a pulsating pressure line 31 through a non-return flap valve 30. The line 31 is connected to the engine crankcase through a pressure tube 8. The non-return valve 30 includes a movable tongue-shaped portion made of rubber or the like, formed by a U-shaped cut in the central area of the valve. It is mounted in a stepped recess 32 by a ring 33. The non-return valve 30 normally closes the passage B by reason of its elasticity. The valve 30 is opened, however, as shown in the drawing, when positive pressure from the crankcase is communicated to the passage B through the line 31. Conversely, negative pressure closes the valve 30 and passage B, whereby the valve 30 maintains a positive pressure in the chamber 29 during normal engine operation. The valve 30 has a small bleed hole 34 in its flap or tongue for venting the pressure in the chamber 29 after the engine has stopped, whereby the spring 26 gradually closes the valve 21. Thus, during the operation of the engine the diaphragm 22 is urged upwardly or raised by the positive pressure in the chamber 29, the valve 21 is lifted from its seat 25 to open the passage 24, and the filtered fuel in chamber 19 flows into chamber 23.

Chamber 23 communicates with the two fuel outlet lines 40 in the upper cover 12 through a passage 36 in the upper body 13, a fuel inlet non-return valve 37, a fuel pump chamber 38 in the lower body 14, a fuel outlet non-return valve 39, and a passage 41. The non-return valves 37, 39 comprise movable tongues of rubber or the like similar to the valve 30, and both are integral with the diaphragm 22. Valve 37 normally closes the passage 36, and valve 39 normally closes the passage 41. The fuel pump chamber 38 in the lower body 14, and a pulsating chamber 44 in the lower cover 15 for operating the pump, are separated by the fuel pump diaphragm 43.

Chamber 44 is connected to the pulsating pressure line 31 through a passage A. The diaphragm 43 is clamped between the lower body 14 and the lower cover 15 by the bolts 27. Reference numeral 45 designates a gasket member.

In operation, fuel is supplied from a tank, positioned higher than the integrated system 10, to the intake line 17 through the fuel pipe 2, and flows into the chamber 19 after passing through the filter 18. Positive pressure from the crankcase is accumulated in the chamber 29 by the pulsating opening and closing of the non-return valve 30 during the operation of the engine, which raises the diaphragm 22 and opens the valve 21. As a result, the fuel flows through the passage 24 and the chamber 23 into passage 36.

When the diaphragm 43 is pulled down by a negative pressure cycle in the crankcase, the pressure in the fuel pump chamber 38 becomes negative whereby the non-return valve 37 opens and the non-return valve 39 closes. Accordingly, the fuel in passage 36 flows into the pump chamber 38 through the opened valve 37. When the diaphragm 43 is subsequently raised in response to a positive crankcase pressure, the valve 37 closes and the fuel in chamber 38 opens and exits through valve 39 into passage 41, and then through the outlet lines 40 to the engine carburetor. The operation continues in this alternating, pulsating manner, with a quantity of fuel being pumped out of the lines 40 during each positive pressure cycle of the crankcase.

Referring now to the embodiment shown in FIG. 4, a non-return valve 30′ having a bleed hole therein is mounted in the upper body 13, in a reverse manner with respect to the valve 30 in FIG. 3. Accordingly, the valve 30′ is opened by the application of negative pressure through the passage B, while it is closed by positive pressure therein. Thus, negative pressure accumulates in the chamber 29′ above the non-return valve 30′ during the engine operation, to thereby lift the diaphragm 22 and with it the valve 21 from its seat 25, and enable fuel to flow from the intake line 17 through the passage 16, filter 18, and open valve 21 into the passage 36. The remaining structure and functioning corresponds to that described above in connection with FIG. 3, as may be readily seen.

Figure 5:
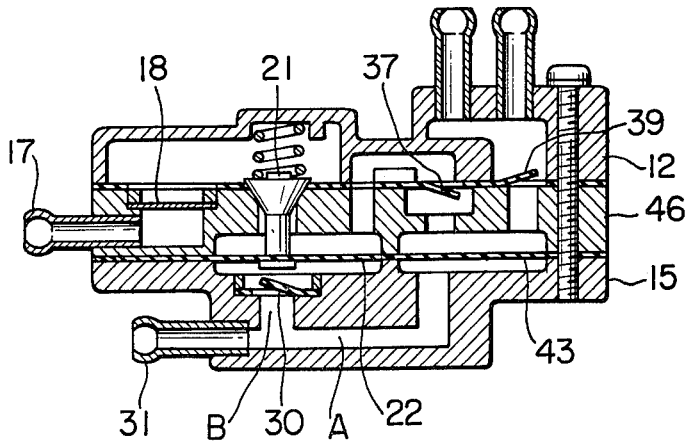
FIG. 5 shows a longitudinal sectional view of a further embodiment wherein the valve operating diaphragm and fuel pump diaphragm are integrally combined.

The embodiment of FIG. 5 is similar to that of FIG. 3, but the non-return valves 37, 39 have been separated from the valve operating diaphragm 22 and, with some changes in the passages 36, 41, moved upward in the housing assembly. The fuel pump chambers 38, 44 and the fuel pump diaphragm 43 have also been raised, and the latter made integral with the diaphragm 22. This arrangement is somewhat simpler from a construction and assembly standpoint in that, inter alia, it involves only three transverse structural members — an upper cover 12, a central body 46, and a lower cover 15.

Figure 1:
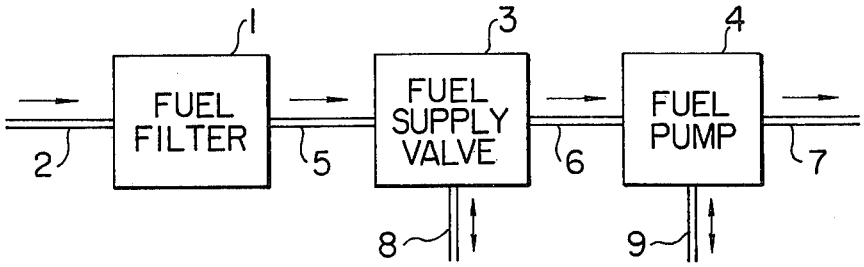
FIG. 1 PRIOR ART
FIG. 1 shows a block diagram of a conventional fuel supply system.

Thus, the present invention comprises an automatic fuel valve section including a valve 21 operated by a diaphragm 22 arranged opposite a positive pressure chamber 29 (FIG. 3) or a negative pressure chamber 29′ (FIG. 4), a fuel pump section including non-return valves 37, 39 operated by a diaphragm 43, and a filtering section 16, 18. Consequently, only a fuel inlet line 2 for connecting the fuel tank to the unit 10, a fuel outlet line(s) 7 from the unit 10 to the carburetor, and a crankcase pressure line 8 are required, which greatly simplifies installation and hookup. On the other hand, as shown in FIG. 1, the conventional system requires four fuel lines and two pressure lines.

The non-return valve 30 or 30′ may be incorporated directly in fuel pump diaphragm 43, if desired, whereby the ring 33 may be eliminated and the unit assembly process simplified. Further, the non-return valves 37, 39 may, in the embodiment of FIG. 4, be integrally combined or incorporated in the valve operating diaphragm 22 with minor modifications to the internal passage and chamber configurations.

What is claimed is:

1. An integrated fuel supply system for an internal combustion engine, comprising:
   (a) a fuel inlet passage (16),
   (b) a first chamber communicating with said fuel inlet passage (19),
   (c) a fuel filter (18) disposed between the inlet passage and the first chamber,
   (d) a second chamber (23,36),
   (e) a normally closed biased valve (21) disposed between the first and second chambers,
   (f) a valve diaphragm (22) operably engaged with the valve,
   (g) a pressure chamber (20,29′) disposed on one side of the valve diaphragm for accumulating a pressure which produces a force in the opposite direction of the spring bias of the valve thereby tending to open the value,
   (h) passage means (B) for communicating with a source of pulsating pressure,
   (i) a non-return valve (30, 30′) disposed between the passage means and the pressure chamber,
   (j) a fuel pump chamber (38),
   (k) a fuel outlet passage (41),
   (l) valve means (37,39) individually disposed between the second chamber and the fuel pump chamber and between the fuel pump chamber and the fuel outlet passage,
   (m) a pump diaphragm (43) operatively communicating on one side thereof with the pump chamber,
   (n) passage means (A) for communicating the source of pulsating pressure to the other side of the pump diaphragm, and
   (o) a unitary housing assembly mounting and defining therein all of the above-recited structure.

2. A system as defined in claim 1, wherein the valve means (37, 39) comprise oppositely oriented non-return flap valves integral with the valve diaphragm (22).

3. A system as defined in claim 1, wherein the non-return valve (30, 30′) comprises a flap valve having a bleed passage therein.

4. A system as defined in claim 1, wherein the valve diaphragm (22) is disposed between the second chamber and the pressure chamber.

5. A system as defined in claim 2, wherein the valve diaphragm (22) is disposed between the second chamber and the pressure chamber.

6. A system as defined in claim 5, wherein the valve diaphragm (22) is integral with the pump diaphragm.

7. A system as defined in claim 1, wherein the valve diaphragm (22) is integral with the pump diaphragm.

* * * * *